United States Patent [19]

Wilmotte

[11] 4,300,376

[45] Nov. 17, 1981

[54] COOLING OF ROLLED METAL PRODUCTS

[75] Inventor: Stephan H. Wilmotte, Chaudfontaine, Belgium

[73] Assignee: Centre de Recherches Metallurgiques-Centrum voor Research in de Metallurgiques, Brussels, Belgium

[21] Appl. No.: 80,066

[22] Filed: Sep. 28, 1979

[30] Foreign Application Priority Data

Oct. 2, 1978 [BE] Belgium ..... 870959
Oct. 2, 1979 [BE] Belgium ..... 879960

[51] Int. Cl.[3] ..... B21B 43/00; B21B 45/02
[52] U.S. Cl. ..... 72/201; 266/113
[58] Field of Search ..... 72/201; 134/64 R, 122 R; 164/89, 444; 239/521, 553.3, 590.3, 590.5; 266/113

[56] References Cited

U.S. PATENT DOCUMENTS

| | | | |
|---|---|---|---|
| 2,893,409 | 7/1959 | Wulf | 266/113 X |
| 2,921,488 | 1/1960 | Davis | 72/201 |
| 3,041,686 | 7/1962 | Hazelett et al. | 164/89 X |
| 3,208,742 | 9/1965 | Peretick | 266/113 |
| 3,671,028 | 6/1972 | Hemsath | 266/113 |
| 3,793,867 | 2/1974 | Safford | 72/201 |
| 3,856,281 | 12/1974 | Bertolotti et al. | 266/113 X |
| 3,880,358 | 4/1975 | Schaming | 72/201 X |
| 4,076,222 | 2/1978 | Schaming | 266/113 X |
| 4,210,288 | 7/1980 | Dobson | 266/113 X |
| 4,226,108 | 10/1980 | Wilmotte et al. | 72/201 |

FOREIGN PATENT DOCUMENTS

| | | | |
|---|---|---|---|
| 291580 | 6/1928 | United Kingdom | 266/113 |

*Primary Examiner*—Ervin M. Combs
*Attorney, Agent, or Firm*—Holman & Stern

[57] ABSTRACT

Continuously cooling a rolled metal product emerging from the last stand of a rolling mill by spraying a liquid coolant through at least one outlet orifice of at least one hollow housing onto a rolled product vertically downwardly in the form of a compact jet of liquid which does not include any gaseous constituents and all the molecules of which are at the same speed in a given cross-section transverse to the direction of the jet.

8 Claims, 6 Drawing Figures

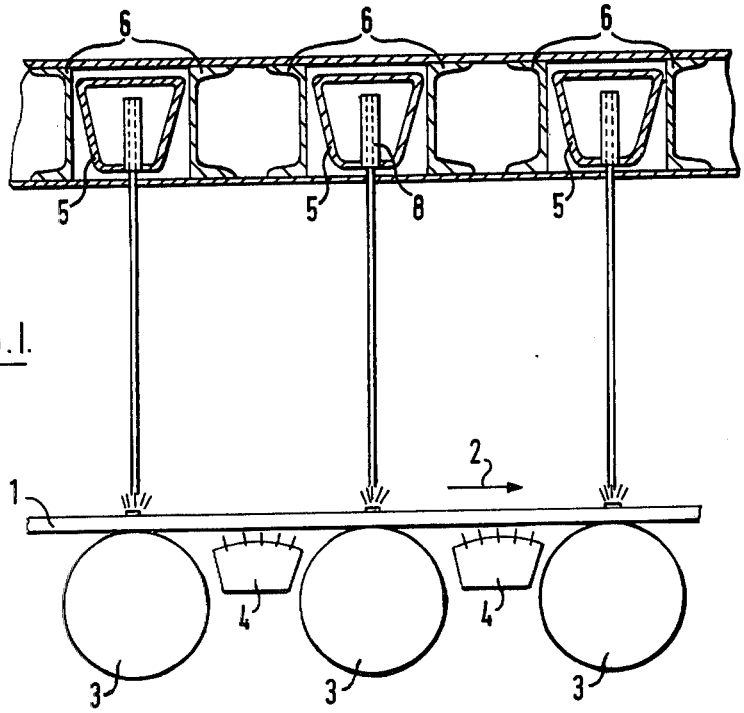
FIG. 1.
FIG. 2.
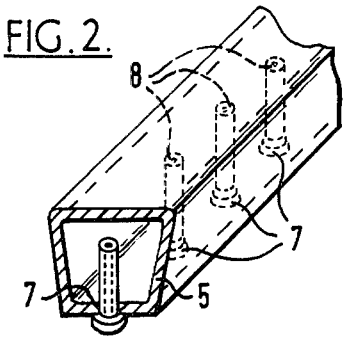
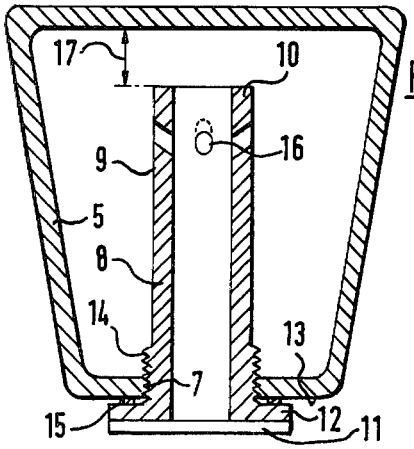
FIG. 3.
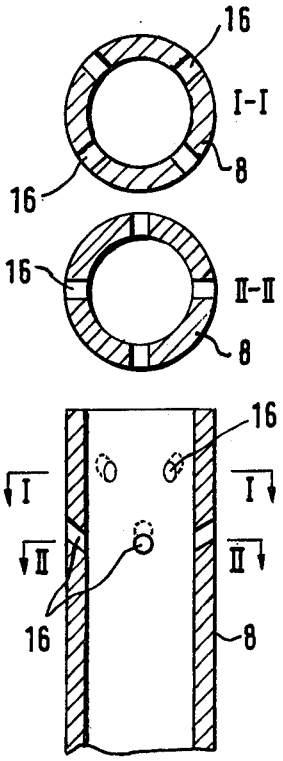
FIG. 4.

COOLING OF ROLLED METAL PRODUCTS

BRIEF SUMMARY OF THE INVENTION

The present invention relates to the cooling of rolled metal products, particularly in the rolling of sheet steel.

The efficiency of a device for cooling rolled metal products emerging from a finishing stand of a rolling mill may be evaluated objectively by means of a suitably determined parameter, such as the heat exchange coefficient; the larger this coefficient, the more effective the cooling.

From this point of view, the applicants have already developed a device enabling cooling of such rolled products to be carried out. This device, which is characterized by a particularly high heat exchange coefficient, comprises one or more cooling ramps in which a bank of jets spray a mist composed substantially of atomized water and air against the rolled product passing in front of the ramps.

The cooling efficiency of this device was found to be remarkable in a large number of treatments of sheet, bars, and profiled sections. However, in order to be effective this device must be placed in close proximity to the rolled product to be cooled, for example less than 10 cm. It is therefore not possible to use such a device when the operating conditions are such that the distance between the rolled product to be cooled and the cooling device is much greater (for example 2 m) and which may in addition vary as a result of the different dimensions of rolled products to be cooled at the same point of a plant.

It is an object of the present invention to provide a device for cooling rolled metal products which overcomes the above-mentioned drawbacks in a simple and effective way.

The present invention in one aspect provides a device for continuously cooling a rolled metal product emerging from the last stand of a rolling mill, comprising at least one hollow housing provided with at least one outlet orifice for spraying a liquid coolant onto a said rolled product in the vertical or a substantially vertical direction downwardly in the form of a compact jet of liquid which does not include any gaseous constituents and all the molecules of which are at the same speed in a given cross-section transverse to the direction of the jet.

The length of the housing of the device according to the invention is chosen to be appropriate to the width of the product to be cooled, and the transverse dimensions of the housing are selected to enable it to be positioned at the required place (for example between two supports).

The invention in another aspect provides a method of continuously cooling a rolled metal product emerging from the last stand of a rolling mill, comprising spraying a liquid coolant through at least one outlet orifice of at least one hollow housing onto a said rolled product in the vertical or a substantially vertical direction downwardly in the form of a compact jet of liquid which does not include any gaseous constituents and all the molecules of which are at the same speed in a given cross-section transverse to the direction of the jet.

According to a first embodiment of the invention, the housing is preferably provided on its front face, i.e. the face through which the cooling liquid is sprayed, with a plurality of suitable orifices.

The or each outlet orifice of the housing may be suitably located at the end of a cylindrical tube, for example of metal, through which the cooling liquid must pass, and whose minimum length is 5 times its inner diameter, this tube being provided at an inlet end thereof with a plurality of lateral conduits for enabling the cooling liquid to be introduced into the tube, the conduits being uniformly spaced over the periphery of at least one vertical section of the tube, the respective axes of the conduits preferably meeting the axis of the tube and being inclined with respect to the latter in the outlet direction of the tube at an angle of from 20° to 60°.

Although the inlet orifice of the tube may be closed, it has proved preferably to leave it open; experiments have in fact shown that leaving the tube inlet open improved the quality of the coherent jet produced.

The lateral conduits are preferably spaced over a tube length which does not exceed $\frac{1}{3}$ of its total length.

If the tubes are left open at their inlet end, a minimum space between this end and the upper edge of the housing is maintained, so as not to affect the free passage of the liquid to the inlet end; in addition, if this space is very large there occurs the disadvantage that the response time of the device is increased.

The above-described device enables a cylindrical coherent jet of satisfactory quality to be obtained in a particularly economic way; the parts of the device may be readily assembled or dismantled within or outside its housing.

According to a second embodiment of the invention, the housing is preferably provided with an outlet orifice directed normally downwardly and having the form of a substantially horizontal rectangle one of the sides of which is substantially larger than the other, for example more than ten times, the lateral faces of the housing corresponding to the small sides of the outlet orifice being substantially planar, parallel to one another and perpendicular to the large sides of the orifice, and the lateral faces of the housing corresponding to the large sides of the outlet orifice being slightly convergent in the direction of displacement of the liquid passing through the housing, the housing having at its inlet means enabling it to be uniformly supplied over the entire inlet section thereof.

The angle of convergence between the two large lateral faces of the housing is determined so as to enable the stream of liquid passing through the housing to be made coherent.

One of the large faces of the housing may be suitably slightly extended at its outlet end, for example by 5 cm, so that it may act as a guide for the stream of liquid emerging from the housing.

BRIEF DESCRIPTION OF THE SEVERAL VIEWS OF THE DRAWINGS

The invention will be further described, by way of example only, with reference to the accompanying drawings, in which:

FIG. 1 is a diagrammatic longitudinal sectional view of a plant for cooling rolled products, provided with a device according to the invention;

FIG. 2 is a perspective view of a section of a device according to the invention;

FIGS. 3 to 5 are sectional views of various modifications of the device according to the invention.

DETAILED DESCRIPTION

Figure 5:
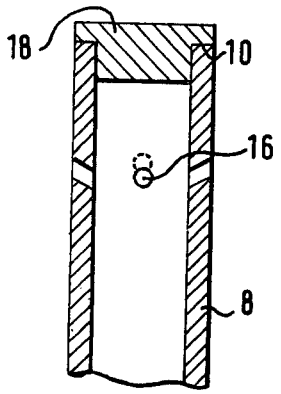

In FIG. 1, a rolled metal sheet product 1 is displaced in the direction of the arrow 2, while being supported on a series of rollers 3. Box units 4 are disposed between the rollers 3, the function of these box units being to spray a cooling liquid onto the lower face of the sheet.

At the upper part of the plant, a series of transverse trapezium-shaped housings 5 are each supported by two U-shaped iron bars 6, which are themselves supported by the framework of the plant. Each housing 5 is disposed substantially above a roller 3. Each housing has in its lower wall a series of orifices 7 (FIG. 2) disposed in a straight row and enabling a series of tubes 8 to be introduced into the housing. These housings are supplied with water (not shown) at a level lower than that at which the water is introduced into the tubes 8.

FIG. 3 shows in cross-section a housing 5 provided with an orifice 7 in its lower wall. A tube 8 comprises a cylindrical part 9, open at its upper end 10 and provided, on the side of its outlet orifice 11, with a shoulder 12 supported against the external face 13 of the lower wall thereof. The tube 8 is inserted into the housing and is fixed there by screwing a threaded boss 14 which is rigid with it into a screw thread extending over the thickness of the lower wall surrounding the orifice 7. An annular joint 15 ensures that the fastening is leak-tight.

The upper part of the tube 8 is provided with a series of cylindrical holes 16 disposed obliquely downwardly in the direction of the interior of the tube and uniformly distributed over the periphery of this section of the tube; a minimum spacing 17 is ensured between the end 10 and the upper wall of the housing 5, in order to enable the upper part of the tube to be correctly supplied, at least via the holes 16. However, this spacing should be relatively small, in order to minimise the response time of the plant.

FIG. 4 is a diagrammatic representation of a modification of the upper part of a tube 8 in which the holes 16 are spaced uniformly along two different levels, the vertical sections of which correspond to the sections I and II of this figure.

FIG. 5 shows another modification of the tube 8 shown in FIG. 3 in which the upper end 10 of the tube is closed, for example by means of a cork 18, which restricts the inlet of water into the tube to the holes 16.

Figure 6:
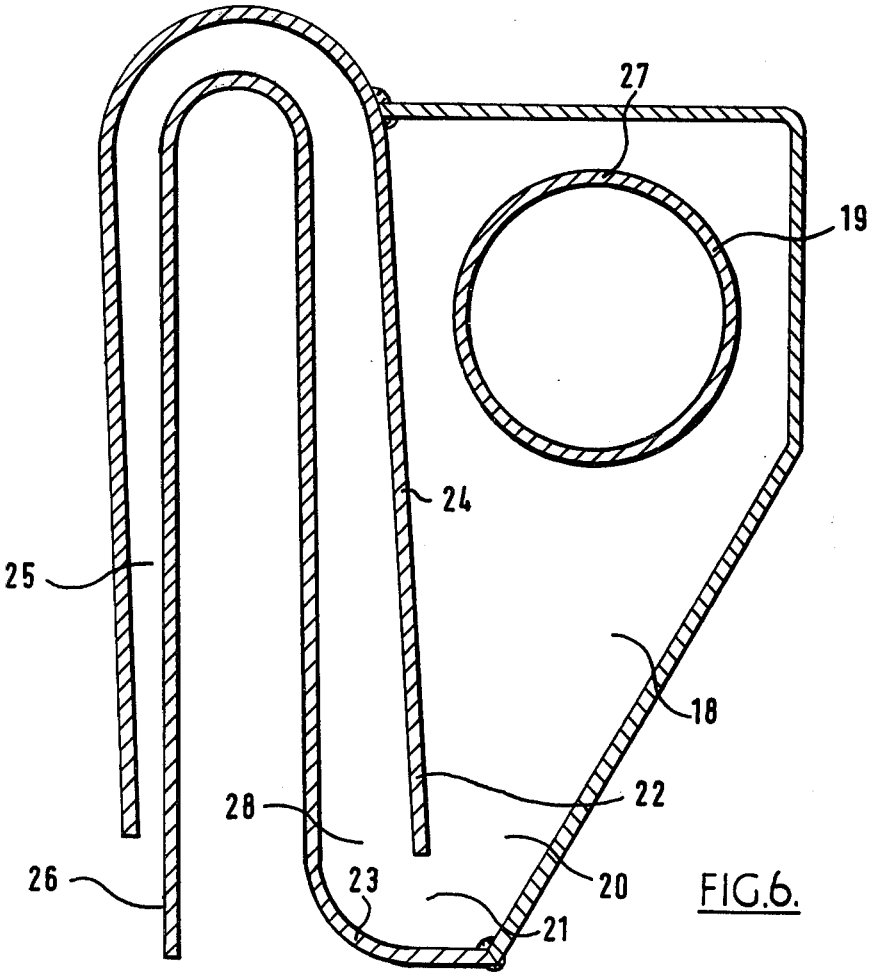
FIG. 6 is a cross-sectional view of a second embodiment of a device in accordance with the invention.

The device shown in FIG. 6 comprises a longitudinal funnel 18 serving to supply a device 28 with liquid, the device 28 forming a coherent jet; the funnel 18 is fed by a preferably cylindrical tube 19 which is itself fed either at one end or at both ends thereof.

The tube 19 is provided with a series of supply holes 27, disposed on one or more of its generatrices; the total surface area of the holes is preferably less than that of the outlet orifice of the funnel 18, thus enabling an homogeneous supply of the coherent jet.

The funnel 18 is provided at its lower end 20 with an outlet orifice 21 between walls 22 and 23 of the device 28, the orifice 21 having a rectangular cross-section, the large sides of which, perpendicular to the section shown in the drawing, extend along the entire base of the funnel. At the outlet of the funnel 18 the liquid follows a path in the shape of an upturned U formed by two longitudinal walls 24 and 25 which become progressively closer. The lateral walls closing the upturned U-shaped housing are constituted by the same sheet of metal as that which constitutes the end walls of the funnel 18. The orifice 21 also serves as the coolant inlet to the U-shaped housing.

One of the large faces forming the U is slightly extended at 26, for the purpose of guiding the liquid stream emerging from the U.

The operation of this device is self-evident; it should be noted that the supply of the U-shaped housing is achieved in a uniform manner over its entire length, by means of the outlet orifice 21 and the distribution of the supply holes 27 in the tube 19.

I claim:

1. A device for continuously cooling a rolled metal product emerging from the last stand of a rolling mill, comprising at least one hollow housing for carrying a liquid coolant, a plurality of substantially vertical cylindrical tubes, each tube having an upper end inside the housing and a lower end outside the housing and a length at least five times its inner diameter, a plurality of lateral conduits through which the liquid coolant enters each tube from the interior of the housing extending through a portion of the tube inside the housing adjacent the upper end of the tube, the length of said portion not exceeding one-third of the length of the tube and the conduits being uniformly spaced over the periphery of at least one cross-section of the tube, the axes of the conduits intersecting the axis of the tube at an angle of inclination thereto of from 20° to 60°, whereby the tube produces a compact jet of liquid coolant which does not include any gaseous constituents and all the molecules of which are moving at the same speed in a given cross-section transverse to the direction of the jet.

2. The device of claim 1, wherein the upper end of each tube is closed.

3. The device as claimed in claim 1, wherein said housing is elongated and is supported in spaced relationship to said product so that its longitudinal axis is substantially transverse to the path of travel of said product, and said tubes are longitudinally spaced.

4. The device of claim 3, wherein said housing has a cross-sectional configuration transverse to said longitudinal axis in the form of a trapezoid and said tubes extend through that one of the parallel walls of said housing which has the smaller dimension.

5. The device of claim 4, wherein said tubes are removably connected to said housing by cooperating screw thread means on said tubes and in said wall of said housing, and sealing means is provided between said tubes and the outer surface of said wall of said housing.

6. A device for continuously cooling a rolled metal product emerging from the last stand of a rolling mill, comprising a hollow elongate housing having a cross-sectional shape transverse to the longitudinal axis thereof in the form of an inverted U, one extremity of the U having an elongate liquid coolant outlet and the other extremity having an elongate liquid coolant inlet, a supply funnel connected to said inlet, a liquid coolant supply tube disposed in said funnel substantially parallel to said inlet and adapted to be supplied with liquid coolant through at least one of its ends, a plurality of outlet apertures extending through said supply tube and distributed along it to enable said housing to be uniformly supplied with liquid coolant over the entire coolant inlet, said liquid coolant outlet defining an outlet orifice having the form of a substantially horizontal rectangle one side of which is substantially larger than the other, the lateral faces of the housing corresponding to the small sides of the outlet orifice being substantially planar, substantially vertical and parallel to each other, and the lateral faces of the housing corresponding to the large sides of the orifice converging towards each other slightly in the direction of displacement of the liquid coolant passing through the housing, whereby the housing produces a substantially vertically downwardly directed compact jet of liquid coolant which does not include any gaseous constituents and all the molecules of which are moving at the same speed in a given cross-section transverse to the direction of the jet.

7. The device according to claim 6, wherein one of the large faces of the housing is slightly extended at its outlet end.

8. The device of claim 6, wherein the total surface area of said outlet apertures extending through said supply tube are less than that of said outlet orifice.

* * * * *